US008202577B2

(12) United States Patent
Mimura et al.

(10) Patent No.: US 8,202,577 B2
(45) Date of Patent: Jun. 19, 2012

(54) METHOD FOR PRODUCING ARTIFICIAL LEATHER SHEET

(75) Inventors: Masahisa Mimura, Shimane (JP); Shogo Takahashi, Shimane (JP)

(73) Assignee: Teijin Cordley Limited, Shimane (JP)

( * ) Notice: Subject to any disclaimer, the term of this patent is extended or adjusted under 35 U.S.C. 154(b) by 0 days.

(21) Appl. No.: 12/713,595

(22) Filed: Feb. 26, 2010

(65) Prior Publication Data

US 2010/0151133 A1 Jun. 17, 2010

Related U.S. Application Data

(62) Division of application No. 11/663,223, filed as application No. PCT/JP2005/017657 on Sep. 20, 2005, now abandoned.

(30) Foreign Application Priority Data

Sep. 22, 2004 (JP) ..... 2004-274776

(51) Int. Cl.

| | |
|---|---|
| ***B05D 5/00*** | (2006.01) |
| ***B05D 3/12*** | (2006.01) |
| *A63B 37/12* | (2006.01) |
| *A63B 39/06* | (2006.01) |
| *D06N 3/00* | (2006.01) |

(52) U.S. Cl. ..... 427/359; 427/384; 427/393.5; 427/407.1; 427/412.1

(58) Field of Classification Search ..... 427/359, 427/384, 393.5, 407.1, 412.1
See application file for complete search history.

(56) References Cited

U.S. PATENT DOCUMENTS

| | | | | | |
|---|---|---|---|---|---|
| 3,861,937 | A | * | 1/1975 | Hanneken et al. | 428/151 |
| 3,988,488 | A | * | 10/1976 | Civardi | 428/89 |
| 4,018,954 | A | * | 4/1977 | Fukushima et al. | 428/86 |
| 4,028,161 | A | * | 6/1977 | Fukushima et al. | 156/153 |
| 4,055,693 | A | * | 10/1977 | Civardi | 428/91 |
| 4,122,223 | A | * | 10/1978 | Civardi et al. | 428/91 |
| 4,211,806 | A | * | 7/1980 | Civardi et al. | 428/91 |
| 4,448,831 | A | * | 5/1984 | Civardi | 428/91 |
| 4,620,852 | A | * | 11/1986 | Nishikawa et al. | 8/515 |
| 4,756,947 | A | * | 7/1988 | Nishikawa et al. | 428/151 |
| 5,669,838 | A | | 9/1997 | Kennedy et al. | |
| 6,024,661 | A | | 2/2000 | Guenther et al. | |
| 6,299,977 | B1 | * | 10/2001 | Takeyama et al. | 428/373 |
| 6,413,177 | B1 | | 7/2002 | Guenther et al. | |
| 6,733,859 | B2 | | 5/2004 | Yoneda et al. | |
| 6,739,076 | B2 | * | 5/2004 | Yoneda et al. | 36/98 |
| 6,900,148 | B2 | * | 5/2005 | Yoneda et al. | 442/341 |
| 7,091,139 | B2 | * | 8/2006 | Nobuto et al. | 442/136 |
| 2004/0185245 | A1 | * | 9/2004 | Akamata et al. | 428/323 |

FOREIGN PATENT DOCUMENTS

| | | | | |
|---|---|---|---|---|
| JP | 51-061537 | A | * | 5/1976 |
| JP | 9-31863 | A | | 2/1997 |
| JP | 9-250091 | | | 9/1997 |
| JP | 10-008382 | | | 1/1998 |
| JP | 2001-192976 | A | | 7/2001 |
| JP | 2001-214376 | A | | 8/2001 |

OTHER PUBLICATIONS

JP Communication, dated Aug. 25, 2009, issued in corresponding JP Application No. 2004-274776, 2 pages in Japanese only.
EP Communication, dated Jul. 22, 2009, issued in corresponding EP Application No. 05787510.6, 3 pages.

* cited by examiner

*Primary Examiner* — William Phillip Fletcher, III
(74) *Attorney, Agent, or Firm* — Sughrue Mion, PLLC

(57) ABSTRACT

A method for producing an artificial leather sheet includes (i) coating a solution including an elastic polymer (B) on a substrate layer for forming a composite layer on a surface of the substrate layer, wherein the substrate layer includes ultra fine fibers and an elastic polymer (A), and the substrate layer has ultra fine fiber naps on one surface, the fineness of the ultra fine fibers is 0.0001 to 0.05 dtex, the composite layer includes ultra fine fiber naps and an elastic polymer (B), the ultra fine fiber naps are connected to the fibers constituting the substrate layer, and the elastic polymer (B) is joined to the ultra fine fibers, (ii) pressing the surface of the sheet with an emboss roll for forming hills, and (iii) then coating the top portions of the hills with a solution consisting mainly of an elastic polymer (C).

12 Claims, No Drawings

METHOD FOR PRODUCING ARTIFICIAL LEATHER SHEET

CROSS REFERENCE TO RELATED APPLICATIONS

This is a Divisional of application Ser. No. 11/663,223 filed Mar. 20, 2007, now abandoned, which is a National Stage Entry of PCT/JP2005/017657 filed Sep. 20, 2005. The disclosures of the entire prior applications are hereby incorporated by reference.

TECHNICAL FIELD

The present invention relates to a leather-like sheet, in more detail, to a leather-like sheet suitable for balls used in ball games such as basketball, rugby, American football, and handball, to a method for producing the same, and to a ball using the same.

BACKGROUND ART

From old times, natural leathers have been used as surface materials for balls used in ball games, but in recent years, the wide employment of leather-like sheets, especially leather-like sheets comprising fibers and elastic polymers and called the so-called artificial leathers, have been begun due to the easiness of handling and the like. However, since skin layers comprising elastic polymers have often been formed on the whole surfaces of the artificial leathers to prevent the deterioration of abrasion resistance and the adhesion of soil, the artificial leathers have had a problem that the artificial leathers are slippery, especially easily slippery, when hands sweat in a ball game such as basketball, rugby, or American football in which the balls are treated with the hands.

As a means for decreasing such the slippiness to improve a gripping property on wetting, for example, a method for discontinuously imparting a non-slipping property-exhibiting resin to the surface of an artificial leather having naps has been disclosed in JP-A 9-250091 (JP-A means "Japanese Unexamined Patent Publication"). However, this artificial leather has had a problem that the artificial leather lacks sufficient durability and sufficient abrasion resistance, because the artificial leather has a water-absorbing property in the nap portions but has fuzzes from the first time, and furthermore a problem that the artificial leather is easily soiled, because a film layer is not formed on the surface. Additionally, the artificial leather has had a problem that the nap portions of the surface excessively absorb water to increase the weight of a ball.

DISCLOSURE OF INVENTION

Problems to be Solved by the Invention

The object of the present invention is to provide a leather-like sheet having an excellent gripping property and excellent abrasion resistance, when dried and also when wetted, little changing the weight of the sheet due to the excessive absorption of sweat or the absorption of rain, and especially suitable for balls used in ball games such as basketball, rugby, American football, and handball, which have been impossible with the conventional sheets, to provide a method for producing the leather-like sheet, and to provide a ball using the same.

Means for Solving the Problems

The leather-like sheet of the present invention is a sheet having hills on the surface, and is characterized by having a composite layer comprising nap-like ultra fine fibers connected to fibers constituting a substrate layer and an elastic polymer (B) joined to the ultra fine fibers, on one surface of the substrate layer comprising the ultra fine fibers and an elastic polymer (A), having coating layers consisting mainly of an elastic polymer (C) on the top portions of the hills on the surface of the sheet, and further having through pores reaching the substrate layer through the surface in the side portions between the top portions of the hills and the valley portions of the hills. Further, the fineness of the ultra fine fibers is preferably 0.0001 to 0.05 dtex, and the composite layer has preferably a multi-layered structure having two or more layers, wherein the layer of the elastic polymer (B) in the composite layer on the substrate layer side comprises an elastic polymer (B1), while the layer of the elastic polymer (B) on the coating layer side comprises an elastic polymer (B2). Furthermore, the elastic polymer (B2) comprises preferably a silicone-modified polyurethane.

Additionally, the coating layer has preferably a multi-layered structure having two or more layers, and the surface side layer of the coating layer contains preferably a tackifier. Furthermore, the tackifier is preferably a liquid rubber or a rosin resin, and the liquid rubber is preferably a synthetic liquid rubber having a molecular weight of 800 to 5,000.

In the shapes of the hills on the surface, the average area of the top portions of the hills is preferably 0.5 to 7 $mm^2$, and the differences of elevation between the top portions and the valley portions of the hills are preferably not less than 0.1 mm. Furthermore, the side portions of the hills have preferably not less than 50 through pores per hill.

A method for producing a leather-like sheet of another present invention is characterized by coating a solution comprising an elastic polymer (B) on a sheet which comprises ultra fine fibers and an elastic polymer (A) and has ultra fine fiber naps on the one surface, forming hills on the surface of the sheet with an emboss roll, and then coating the top portions of the hills with a solution consisting mainly of an elastic polymer (C).

Additionally, a ball of the other present invention is characterized by adhering the leather-like sheet according to the other present invention to the surface of a body for the ball.

BEST MODE FOR CARRYING OUT THE INVENTION

The leather-like sheet of the present invention is a sheet which has hills on the surface and whose substrate layer comprises ultra fine fibers and an elastic polymer (A). Furthermore, it is preferable to together use a scrim comprising fibers having an ordinary fineness except the ultra fine fibers or a woven or knitted fabric in the substrate to reinforce the substrate layer.

The ultra fine fibers constituting the substrate are preferably synthetic fibers, especially the fibers of a polyamide such as nylon 6, nylon 6,6 or nylon 12, or the fibers of a polyester such as polyethylene terephthalate or polybutylene terephthalate. The fineness of the ultra fine fibers is preferably 0.0001 to 0.05 dtex. When the fineness is large, it is difficult to obtain the smoothness of the surface, and the roughness of the surface thereby trends to lower the commercial value. Also, when the fineness is too small, it is difficult to industrially stably produce the substrate layer.

Such the ultra fine fibers can be formed, for example, by forming sea-island type conjugated spun fibers, mixed spun fibers or splittable type conjugated spun fibers from two or more fiber-forming polymers having different solvent solubilities, subjecting the formed fibers to a carding process, a cross-wrapping process, a needle-punching process, a heat-pressing process and the like, and then extracting one component from the obtained intertwined fiber nonwoven fabric by a solvent extraction method or the like, or by splitting the conjugated fibers by a physical or chemical means. For example, it is preferable to select polyamide fibers or polyester fibers as the island component constituting the ultra fine fibers and also select low density polyethylene, polystyrene, polypropylene or the like as the sea component.

Herein, the elastic polymer (A) together used with the ultra fine fibers for the substrate layer includes polyurethane elastomers, polyurethaneurea elastomers, polyurea elastomers, polyester elastomers, and synthetic rubbers, especially preferably the polyurethane-based elastomers. The polyurethane-based elastomers include an elastomer obtained by reacting a polymer diol having a molecular weight of 800 to 4,000, for example, a polyether-based diol such as polyethylene glycol, or polytetramethylene ether glycol, an ester-based diol such as polyethylene adipate or polybutylene adipate, or a carbonate-based diol such as polybutylene carbonatediol, or polyhexamethylene carbonatediol, a diisocyanate such as tolylene diisocyanate, diphenylmethane-4,4'-diisocyanate, hexamethylene-1,6-diisocyanate, 3,3,5-trimethyl-5-isocyanate, or methylcyclohexyl isocyanate, and a low molecular weight chain extender such as ethylene glycol, tetramethylene glycol, propylenediamine, or 3,3,5-trimethyl-5-aminomethylcyclohexylamine.

The substrate layer of the present invention can be obtained, for example, by impregnating an organic solvent solution or aqueous emulsion of the elastic polymer (A) into a fibrous substrate comprising mixed spun fibers or composite spun fibers before converted into the ultra fine fibers, and then converting the fibers into the ultra fine fibers, but it is preferable to use a solution of the elastic polymer (A) in an organic solvent such as DMF to sharpen the hills, and adopt a wet impregnation method.

Herein, the ratio (R/F) of the weight (R) of the elastic polymer (A) in the substrate layer to the weight (F) of the fibers constituting the fibrous substrate is preferably in the range of 0.5 to 1.5, more preferably not less than 0.6, especially preferably not less than 0.65. When the R/F value is large, the shapes of the hills of the surface tend to be sharpened, and when the sheet is used, the shapes of the hills tend to be little changed. The hills are preferable to have independent shapes, especially preferably to have shapes giving a deep pattern such as a conical trapezoidal emboss pattern, thereby enabling the production of balls having excellent commodity grades. In order to improve the R/F, it is necessary to enhance the concentration of the elastic polymer in the impregnation solution. Although the viscosity of the impregnation solution tends to increase, the improved R/F value can be obtained by adopting a forcible press-in method such as a method wherein a fibrous substrate is nipped with rolls in an impregnation solution.

In the sheet of the present invention, it is essential that a composite layer comprising the nap-like ultra fine fibers connected to the fibers constituting the substrate layer and an elastic polymer (B) joined to the ultra fine fibers exists on one surface of the substrate layer. The elastic polymer (B) may be the same elastic polymer as the above-mentioned elastic polymer (A), but it is preferable that the elastic polymer (B) is a polycarbonate-based polyurethane. The solid content adhesion quantity of the elastic polymer (B) is preferably in the range of 5 to 30 g/m$^2$. It is preferable that the nap-like ultra fine fibers are uniform, and it is preferable that the nap-like ultra fine fibers not having irregularity on the naps and similar to, for example, a known suede-like or nubuck-like artificial leather are used as a base material.

In addition, it is preferable that the composite layer has a multi-layered structure having two or more layers, wherein the layer of the elastic polymer (B) in the composite layer on the substrate layer side comprises an elastic polymer (B1), while the layer of the elastic polymer (B) on the coating layer side comprises an elastic polymer (B2). The elastic polymer (B1) on the substrate layer side is especially preferably a polycarbonate-based polyurethane which has polycarbonate-based soft segments and uses an aliphatic, alicyclic or aromatic isocyanate, and has preferably a 100% extension modulus of 60 to 150 kg/cm$^2$, more preferably 80 to 130 kg/cm$^2$. The solid content adhesion quantity is preferably in the range of 1.5 to 5 g/m$^2$.

The elastic polymer (B2) on the coating layer side is also preferably a polycarbonate-based polyurethane which has polycarbonate-based soft segments and uses an aliphatic, alicyclic or aromatic isocyanate, but is more preferably a silicone-modified polyurethane into which silicone segments are introduced in an amount of 5 to 30 percent by weight, preferably 10 to 20 percent by weight, based on the weight of the polyurethane. When the silicone-modified polyurethane is herein used, the hills can more be clarified to improve the sharpness and maintainability of the pattern and give a characteristic soft, smooth feeling and a characteristic touch. The 100% extension modulus of the elastic polymer (B2) is preferably 60 to 180 kg/cm$^2$, more preferably 80 to 130 kg/cm$^2$. The solid content adhesion quantity is preferably in the range of 5 to 25 g/m$^2$, more preferably in the range of 10 to 20 g/m$^2$.

The sheet of the present invention is essential to have coating layers consisting mainly of an elastic polymer (C) on the top portions of the hills on the surface, and have through pores reaching the substrate layer through the surface in the side portions between the top portions and the valley portions of the hills. Further, the coating layer has preferably a multi-layered structure having two or more layers, and the most surface layer of the coating layer contains preferably a tackifier. The tackifier is preferably a liquid rubber or a rosin resin, and the liquid rubber is preferably a synthetic liquid rubber having a molecular weight of 800 to 5,000. The coating layer consisting mainly of the elastic polymer (C) may exit also at portions except the top portions of the hills, when the through pores reaching the substrate through the surface are perfectly not closed, but the absence is basically preferable.

Such the elastic polymer (C) may be the same elastic polymer as the elastic polymer (B) mentioned previously, but is preferably a polyurethane elastomer using one or more of a polycarbonatediol, a polyetherdiol, and a polyesterdiol each having a molecular weight of 800 to 4,000 and an aliphatic, alicyclic or aromatic diisocyanate. The 100% extension modulus of the elastic polymer (C) is 60 to 130 kg/cm$^2$, preferably 80 to 110 kg/cm$^2$. When the 100% extension modulus is small, the gripping property tends to be improved, but the abrasion resistance tends to be lowered. Conversely, when the 100% extension modulus is large, the abrasion resistance tends to be improved, but the gripping property tends to be lowered. The solid content adhesion quantity of the elastic polymer (C) is preferably in the range of 5 to 30 g/m$^2$. The thickness of the coating layer is preferably in the range of 10 to 500 μm.

Furthermore, the elastic polymer (C) also preferably has a multi-layered structure comprising two or more elastic polymers. Therein, it is preferable that the elastic polymer (C) also has elastic polymers (C1), (C2) from the substrate layer side similarly to the elastic polymers (B1), (B2) of the composite layer.

The elastic polymer (C2) constituting the surface of the coating layer may be an ordinary polyurethane elastomer, but is preferably a silicone-modified polyurethane into which silicone segments are introduced in an amount of 5 to 30 percent by weight, further 10 to 20 percent by weight, based on the weight of the polyurethane, especially preferably a silicone-modified polycarbonate-based aliphatic or alicyclic non-yellowing polyurethane elastomer. When such the silicone-modified polyurethane is used, improved abrasion resistance, characteristic slipperiness, and characteristic touch can be obtained.

In addition, it is preferable that the most surface layer of the coating layer contains a tackifier. In this case, a structure comprising three or more layers of the elastic polymer (C1), the elastic polymer (C2), and the elastic polymer containing the tackifier (C2') in this order from the substrate layer side is preferable. As the solid content adhesion amounts of these elastic polymers, in the order from the substrate layer side, the elastic polymer (C1) is preferably in the range of 1.5 to 5 g/cm$^2$; the elastic polymer (C2) is preferably in the range of 2 to 8 g/m$^2$ which are the same as or larger than the amount of (C1); and the elastic polymer containing the tackifier (C2') is preferably in the range of 4 to 20 g/m$^2$.

The tackifier preferably contained in the elastic polymer (C) of the most surface layer includes rosin resins and liquid rubbers which may be used singly or in a mixed state. Among them, a liquid rubber, a low molecular weight synthetic rubber having a molecular weight of 1,000 to 4,000, is preferable. Especially, low molecular weight polybutadiene, low molecular weight acrylonitrile-butadiene copolymer, low molecular weight polydicyclopentadiene, and the like are preferable. Further, the content of the tackifier in the surface layer is preferably 5 to 100 parts by weight, more preferably 10 to 85 parts by weight, most preferably 20 to 70 parts by weight, per 100 parts by weight of the elastic polymer. The addition amount is necessary to be determined in an amount optimal to the levels of the touch and the gripping property required, but when the addition amount is too large, the strength deterioration, abrasion resistance shortage and the like of the coating layer tend to be caused. Additionally, it is preferable to blend a gloss-adjusting agent such as silica, a colored pigment, and a stabilizer in the surface layer. Thereby, the texture, such as gloss, of the surface can be adjusted.

The sheet of the present invention has the hills on the surface. Therein, it is preferable that the top portions of the hills have an average area of 0.5 to 7 mm$^2$, and it is also preferable that the difference of elevation between the top portions and the bottom portions of the hills is not less than 0.1 mm. Additionally, it is preferable that the side portions of the hills have through pores at a rate of not less than 50 through pores/hill.

Such the hills are effective, especially when used for balls used in American football or handball in which balls are gripped and handled with hands. In addition, it is preferable that the total area of the top portions of the hills exists at a rate of 20 to 70% based on the area of the sheet. It is most preferable that the difference of elevation is preferably 0.15 to 1.2 mm, especially preferably 0.2 to 1.0 mm. Herein, the area of the sheet indicates a projected area which is the area of the sheet itself and is observed from the surface, and is different from an area considering the curved shapes of the hills existing on the surface. Herein, each of the top portions is the portion higher than 1/10 from the top in a distance from the top of the hill to the valley bottom, when the hill is observed from the surface material side. By thus having the hills, the gripping property and the durability can be achieved at high levels.

The hill may have a shape that the top portion of the hill is partially connected to the adjacent hill, but it is preferable for increasing the gripping property that the hills are independent each other. The average area of the top portions of the independent hills is preferably 0.5 to 7 mm$^2$, more preferably 1.5 to 4.0 mm$^2$. Additionally, the density of the hills is preferably about 5 to about 100 hills/cm$^2$, more preferably 10 to 60 hills/cm$^2$.

The shape of the independent hill is especially preferably a conical trapezoidal shape due to the aspects of durability, and the like, and further the diameter size of the top portion of the conical trapezoidal hill is preferably 0.8 to 3.0 mm, more preferably 1.2 to 2.5 mm.

It is essential that the sheet of the present invention has through pores reaching the substrate layer through the surface in the side portions between the top portions and the valley bottom portions of the hills, and, additionally, it is preferable that not less than 50 through pores per hill, especially not less than 100 through pores per hill, exist. It is also preferable from the viewpoints of soiling resistance and the like that not more than 1,000 through pores per hill exist. It is further preferable that the number of the through pores is large in the shoulder portion near to the top portion in the side portion.

In addition, the diameter of the pore is preferably 0.5 to 300 μm, further preferably 1 to 200 μm, especially preferably not more than 100 μm. The sheet of the present invention, having such the hills, can improve the gripping property on wetting without deteriorating the durability, because the many pores exit in the side portion.

Herein, the hill top portion is a portion higher than 1/10 from the top in the difference of elevation between the top and valley bottom of the hill, when the hill is observed from the surface material side. The hill valley bottom portion is a portion lower than 8/10 from the top, namely the portion lower than 2/10 from the valley bottom. And the side portion is a portion of 1/10 to 8/10 from the top therebetween.

In addition, in the hill-having surface material of the present invention for the balls, it is preferable that there are opened pores also in the valley bottom portions of the hills except the side portions.

Since there are such the opened pore portions in the leather-like sheet of the present invention, the leather-like sheet can absorb a water film on the surface on wetting to improve the gripping property on the wetting, and can inhibit the excessive absorption of water to effectively control the increase of the weight, when a ball is formed and used. The water-absorbing time of the sheet of the present invention is preferably not less than 240 seconds, more preferably 300 to 600 seconds.

Such the leather-like sheet of the present invention can be obtained, for example, by the following method for producing the leather-like sheet, namely, a method for coating a solution of the elastic polymer (B) on a sheet comprising ultra fine fibers and the elastic polymer (A) and having ultra fine fiber naps on one surface, forming hills on the surface of the sheet with an emboss roll, and then coating a solution consisting mainly of the elastic polymer (C) on the tip portions of the hills.

As the sheet having the ultra fine fiber naps on one surface thereof, used for the production method of the present invention, an artificial leather usually called a suede-like artificial leather can be used. Such the sheet is made up of a fiber aggregate using ultra fine fiber-forming sea-island or splittable type mixed fibers or conjugated fibers and an elastic polymer, and the ultra fine fiber naps on one surface can be obtained by abrading the surface of the sheet comprising the ultra fine fibers and the elastic polymer with sand paper or the like. More concretely, a sheet is preferably obtained, for example, by impregnating a nonwoven fabric comprising sea-island type mixed spun fibers with a polyurethane resin, dissolving and removing the sea component of the obtained fibrous substrate to obtain the sheet having the ultra fine fibers, subjecting the sheet to a gravure treatment using a solvent dissolvable the elastic polymer but not dissolvable the fibers, or the like, to fix the surface of the sheet, and then abrading the surface to obtain the ultra fine fiber naps. When the elastic polymer is, for example, a polyurethane which is dissolvable in dimethyl formaldehyde (hereinafter referred to as DMF) and is used for wet forming treatments, DMF is preferably coated with a 80 to 320 mesh gravure roll, dried to fix the roots of the ultra fine fibers, and then abraded with a abrading machine on which 240 to 640 mesh sand paper is mounted.

Herein, it is preferable that the ultra fine fiber naps are uniform naps having a length of 0.01 to 0.2 mm, preferably not more than 0.1 mm, especially preferably not more than 0.08 mm. Such the naps can be obtained by a method for fixing ultra fine fibers on the surface of a sheet comprising the ultra fine fibers and an elastic polymer, or by a abrading condition or the like.

Subsequently, in the production method of the present invention, it is essential to coat a solution of the elastic polymer (B) on the ultra fine fiber nap-having sheet on one surface. Herein, the elastic polymer (B) is the same as the elastic polymer (B) mentioned above, and it is suitable that the solution for the primer has a concentration in the range of 8 to 15 percent by weight and a viscosity in the range of 100 to 200 cps.

Further, on the coating of the elastic polymer (B), it is preferable that the composite layer comprising the ultra fine fibers and the elastic polymer (B) has the above-mentioned multi-layered structure of the elastic polymer (B1) and the elastic polymer (B2). Therefore, it is preferable to coat a solution comprising the elastic polymer (B1) and then further coat a solution comprising the elastic polymer (B2). At this time, the solution comprising the elastic polymer (B1) has preferably a concentration of 8 to 12 percent by weight and a viscosity of 100 to 180 cps, and the coating amount of the solution is preferably in the range of 20 to 50 g/m$^2$, more preferably 25 to 35 g/m$^2$. The solution comprising the elastic polymer (B1) can be coated, for example, by gravure-coating the sheet having the ultra fine fiber naps with a 50 to 80 mesh gravure roll in an amount of one or two rolls. Also, the solution comprising the elastic polymer (B2) has preferably a concentration of 8 to 15 percent by weight and a viscosity of 100 to 250 cps, and the coating amount of the solution is preferably in the range of 100 to 180 g/m$^2$, more preferably not more than 160 g/m$^2$. The solution comprising the elastic polymer (B2) can be coated by coating the sheet with the elastic polymer (B1), drying the coated sheet, and then gravure-coating the dried sheet with a 70 to 150 mesh gravure roll in an amount of two to eight rolls and further preferably in an amount of four to six rolls.

And, in the method for producing the leather-like sheet of the present invention, the hills are formed on the surface of the sheet with an emboss roll, after the solution comprising the elastic polymer (B) is coated. A pattern formed with the surface shapes of the hills is especially preferably a pattern having conical trapezoidal hills for balls used in basketball or American football. The emboss pattern having such the hills can be imparted by pressing the sheet between a backing roll and an emboss roll on which a pattern opposite to the surface pattern of the target sheet is stamped. Additionally, the difference of elevation between the hills of the mold is preferably 0.2 to 1.5 mm, more preferably 0.3 to 1.0 mm.

By embossing the sheet with the mold having the 0.1 mm or higher hills, the side portions as the slopes of the hills are extended. Thereby, the pores can be formed on the surfaces of the skin layers. Large shear forces together with heat are added to the sheet in areas ranged from the top portions of the hills to the side portions, and the through pores arriving the substrate layer through the surface are consequently formed on the surface of the sheet. Additionally, the mold comprises preferably partially continued hills and independent sunk portions, and is more preferably a complement type mold opposite to the conical trapezoidal hills. The sizes of the top portions of the hills of the sheet can be controlled by adjusting the shape of the mold, and the heights of the hills can also be controlled by adjusting the depth of the mold, the pressure, the temperature, and the time on the emboss processing.

In addition, as a condition of the embossing, the sheet is pressed preferably in the temperature range of −40° C. to +20° C., more preferably in a temperature range of −20° C. to +10° C., on the basis of the softening temperature of the elastic polymer of the coating layer. For example, when a silicone-modified polycarbonate-based alicyclic non-yellowing polyurethane having a softening point of 180° C. is used as the elastic polymer (B), the surface temperature of the emboss roll is preferably in the range of 140 to 200° C., most suitably about 180° C.

In the production method of the present invention, the solution consisting mainly of the elastic polymer (C) is coated on the top portions of the hills formed by embossing the sheet. Herein, the elastic polymer (C) is the same as the elastic polymer (C) mentioned above, but the solution for the top coating has suitably a concentration in the range of 8 to 13 percent by weight, and a viscosity in the range of 100 to 180 cps. The layer consisting mainly of the elastic polymer (C) makes it possible to ensure the abrasion resistance of the surface layers of the hills, prevent the adhesion of soil, suppress excessive water absorbability, improve the touch (impart a soft and smooth feeling), and the like. Furthermore, when the color of the top portions of the hills is changed by the coating using a pigment or the like, a color tone contrast with the layer comprising the elastic polymer (B) of the primer is formed. Thereby, the grade as a ball can be enhanced.

In addition, the elastic polymer (C) is preferably coated so that the coating layer by the top coating may have a multi-layered structure having two or more layers. It is preferable to coat the top portions of the hills with the solution comprising the elastic polymer (C1) mentioned above and then with the solution comprising the elastic polymer (C2) in the same amount or in a larger amount. Furthermore, it is preferable that a solution consisting mainly of an elastic polymer (C2') and containing a tackifier is coated on the most surface layer. Therein, the above-coated solution comprising the elastic polymers (C1) and (C2) has preferably a concentration of 8 to 13 percent by weight and a viscosity of 100 to 180 cps, and is preferably coated in the range of 20 to 40 g/m$^2$. For example, the coating layer can be obtained by gravure-coating the coatings on the top portions of the hills of the sheet with 70 to 110 mesh gravure rolls in amounts of one to four rolls, respectively. The solution which consists mainly of the elastic polymer (C2'), contains the tackifier, and is coated later has preferably a concentration of 8 to 13 percent by weight and a viscosity of 100 to 180 cps, and is preferably coated in the range of 20 to 80 g/m$^2$. For example, the coating layer can be obtained by gravure-coating the tackifier-containing coating on the top portions of the hills of the sheet with a gravure roll in an amount of 2 to 6 rolls.

Furthermore, when the coating layers comprising the elastic polymer are coated on the top portions of the hills of the present invention, it is necessary that the coating layers are formed so as not to close the through pores formed in the side portions of the hills such as the conical trapezoidal hills. In the case of the sheet on whose surface the large hills are formed and which is used in the present invention, the opening pores existing on the side portions are more difficult to be closed than the pores on the top portions and the valley portions, but a method for gravure-coating the sheet through a clearance of 70 to 98% based on the thickness of the sheet is preferable. By coating the elastic polymer on only the top portions of the hills, the surface material having improved surface abrasion resistance and good soiling resistance can be obtained.

Additionally, another present invention is the ball to whose body the leather-like sheet obtained thus is laminated. The game ball can be formed by laminating the leather-like sheet to the body expanded with compressed air, and the game ball is suitably used for basketball, rugby, American football, handball, or the like.

EXAMPLES

The present invention will be explained with Examples in more detail hereafter. Additionally, the present invention is not limited to the scopes of Examples, and parts or % mean parts by weight or percent by weight. The measurement items of the present invention were measured by the following methods, respectively.

(1) Extension Stress

A 0.1 mm thick film that was a JIS K 6301 No. 2 dumbbell test piece was used as a sample, and the test piece was measured with a constant-speed extension tester under a condition of 100%/minute as an extension rate.

(2) Dry Friction Coefficient

While a surface material (width 2.5 cm, length 5 cm) whose moisture had been adjusted under conditions of 23° C. as a temperature and 60% as a relative humidity for 24 hours and on whose surface had hills was placed in contact with the surface of a flat stainless steel plate, the surface material was allowed to move at a rate of 2 m/minute under a load of 500 g, and the surface material was measured for a frictional force (F) to determine a dry friction coefficient $\mu d=F/500$. The frictional force (F) was an average value during the movement of the test piece.

(3) Wet Friction Coefficient

A test piece made of a surface material (width 2.5 cm, length 5 cm) having hills on the surface was immersed in water at 23° C. for 24 hours, and then water adhered to the surface thereof was wiped off with tissue paper. While the test piece was placed in contact with the surface of a flat stainless steel plate, the surface material was allowed to move at a rate of 2 m/minute under a load of 500 g, and the surface material was measured for a friction force (F) (unit; g) to determine a wet friction coefficient $\mu w=F/500$. The frictional force (F) was an average value during the movement of the test piece.

(4) Abrasion Resistance

Measurements were carried out according to JIS L 1079 6.15.3 C method (Taber abrasion test). A truck wheel having 280-mesh sand paper attached thereto was used, and a test piece was abraded 100 times under a load of 500 g. Then, the test piece was evaluated for a surface damage state on the basis of the following ranks.

Rank 5: Color is little change, and the changed color is not conspicuous.

Rank 4: A surface coating layer alone is damaged, and there is no practical problem on appearance.

Rank 3: A porous coating layer is partially damaged (a tolerance limit to practical use).

Rank 2: A porous coating layer is considerably damaged, and the fibers of a substrate layer are partially exposed.

Rank 1: A substrate layer is considerably damaged, and fibers and the like are exposed.

(5) Numbers and Sizes of Pores in Top Portion, Valley Bottom Portion and Side Portion of Hill.

The hill top portion, the hill valley bottom portion, and the side portion therebetween, which exist on the surface of the surface material, are the following portions, respectively, when the hill is observed from the surface material side. The hill top portion is a portion higher than 1/10 from the top in the difference of elevation between the top and valley bottom of the hill. The hill valley bottom portion is a portion lower than 8/10 from the top, namely the portion lower than 2/10 from the valley bottom. And the side portion is a portion of 1/10 to 8/10 from the top between the hill top portion and the hill valley bottom portion.

In Example, the number and size of pores in each hill were measured, and their average values were multiplied by the number of the hills per $cm^2$, as follows.

With respect to the number and sizes of pores in the top portions of the hills, a picture of the surface was taken with a scanning electron microscope at a magnification of 200, and the numbers and sizes of pores were counted and measured in the top portions of five different hills. The numbers of the pores having diameters of 0.5 to 50 μm and an average value thereof were determined and shown.

With respect to the numbers and sizes of pores in the valley bottom portion, the valley bottom portion of the surface material was brought into focus, and a picture was taken with a scanning electron microscope at a magnification of 200. The numbers and sizes of pores were counted and measured. The numbers of the pores having diameters of 0.5 to 50 μm and an average value thereof were determined. The determined average value was converted in a value per $cm^2$, and then shown. Additionally, when the surface material had independent hills, measurements were made in the peripheries of five different hills, and an average value was calculated.

With respect to the numbers and sizes of pores in the side portions, since the sides were the sides of the three-dimensional hills, the hills each was vertically cut into four or more equivalent portions, for preventing the "out of focus", and the pictures of the side portions of the cut hills were taken with a scanning electron microscope at a magnification of 200 and then used. The numbers and sizes of the pores at the hills at five points were counted and measured. The numbers of the pores having diameters of 0.5 to 50 μm and an average value thereof were determined and shown.

(6) Length of Nap of Substrate Layer

Naps on a surface of a substrate layer were arranged in a normal direction, and a picture was taken with a scanning electron microscope at a magnification of 200. The lengths of ten naps on the surface were measured, and an average length was determined.

(7) Sharpness of Emboss

The emboss pattern of a 30 cm-square sample of an embossed leather-like sheet was compared with the pattern of an emboss roll, and evaluated.

Rank 5: A pattern is beautifully reproduced, and has a high grade.

Rank 4: Reproducibility is good, but a grade is inferior.

Rank 3: Acceptable on practical use.

Rank 2: Reproducibility of a pattern is insufficient.

Rank 1: Reproducibility of a pattern is inferior.

(8) Durability of Emboss

A ball for basketball, produced from a leather-like sheet, was used for ten games, and then evaluated by five ranks on the basis of the state of an emboss pattern. Rank 5 is excellent. Rank 3 is acceptable on practical use. Rank 1 is inferior.

(9) Soiling Resistance

A ball for basketball, produced from a leather-like sheet, was used for ten games, and then evaluated by the following ranks on the basis of the soiled state of the ball.

Rank 5: Free from soil, and good.

Rank 4: The ball has slight color difference, but the color difference is insignificant.

Rank 3: Soiled, but acceptable on practical use.

Rank 2: Soil is somewhat large.

Rank 1: Soil is large, and is difficult to come out, even when wiped.

(10) Gripping Property, Touch

A ball used for basketball and made from a leather-like sheet was brought into a dry state and in a moistened state obtained by wetting the balls with water, and the ball was then evaluated by a player. The evaluation was made on the basis of five ranks. Rank 5 is excellent. Rank 3 is acceptable on practical use. And rank 1 is defective.

(11) Water-Absorbing Time

A drop (0.02 $cm^3$) of water was dropped on the top portion of a hill of a leather-like sheet from a position 10 mm-high from the top portion with a buret, and a time taken from just after the dropping to the absorption of the water was measured.

Example 1

Substrate Layer Comprising Ultra Fine Fibers and Elastic Polymer

Nylon-6 and low density polyethylene were blended in a ratio of 50/50, melted and blended in an extruder, blend-spun at 290° C., treated with a finishing oil, and then cut to obtain 4.5 dtex, 51 mm staple fibers. The staple fibers were passed through carding, cross-wrapping, needling and calendering processes to obtain a nonwoven fabric which was an intertwined fibrous substrate having a weight of 480 g/$m^2$, a thickness of 1.6 mm, and an apparent density of 0.3 g/$cm^3$.

On the other hand, a diol mixture of polytetramethylene ether glycol having a molecular weight of 2020 with polyhexamethylenecarbonatediol having a molecular weight of 1980, diphenylmethane-4,4'-diisocyanate, and ethylene glycol were allowed to react in dimethylformamide as a solvent to obtain a polyurethane elastomer having a 100% extension stress of 60 kg/$cm^2$ and a thermosoftening temperature of 180° C. (solid content 20%), as an elastic polymer (A) for impregnation.

100 Parts of the obtained polyurethane elastomer solution, 0.5 part of a porosity-adjusting agent (polyoxyethylene-modified silicone: FG-10, produced by Matsumoto Yushi Seiyaku K.K.), 0.5 part of low molecular weight cellulose propionate, and 0.5 part of a brown pigment were mixed to obtain an elastic polymer solution (impregnation solution) for impregnating a substrate.

Subsequently, the above-mentioned fibrous substrate was immersed in the impregnation solution, repeatedly allowed to pass between nip rolls in the solution to sufficiently replace air in the substrate with the impregnation solution, squeezed in a thickness of 96% based on the thickness of the substrate, immersed in a 20° C. aqueous coagulation solution containing DMF (dimethyl formamide) in a concentration of 10% to coagulate the impregnation solution, washed with water, and then dried. The obtained sheet was repeatedly compressed and relaxed in 90° C. hot toluene to extract the polyethylene used as the sea component in the blend-spun fibers, and then immersed in 95° C. hot water to azeotropically remove the toluene.

The obtained product was a fibrous substrate comprising ultra fine fibers having an average fineness of 0.003 dtex, a nylon-6 fiber (F) impregnation resin (R) weight ratio of 45:55, a resin/fiber weight rate (R/F) of 1.22, and a high rate for filling the resin in the fiber component.

(Leather-Like Sheet)

DMF was coated on the surface of the obtained substrate with 200 and 180 mesh gravure rolls at a rate of about 35 g/$m^2$. Then, the coated substrate was buffed with a grinder having 600 mesh sand paper mounted thereon to obtain a nubuck-like sheet having ultra fine fiber naps which have an average fineness of 0.003 dtex and a nap length of 0.06 mm.

Subsequently, the following coating was prepared as a primer resin (1) solution containing an elastic polymer (B1).

Primer Resin (1)

A polycarbonate-based alicyclic non-yellowing polyurethane (100% extension stress 130 kg/$cm^2$, solid content 20%): 100 parts A solvent mixture (MEK:IPA:DMF=5:4:1):100 parts A colored pigment (brown): 0.6 part Then, the following coating was prepared as a primer resin (2) solution containing an elastic polymer (B2).

Primer Resin (2)

A silicone-modified polycarbonate-based alicyclic non-yellowing polyurethane (100% extension stress 65 kg/$cm^2$, solid content 20%): 100 parts A solvent mixture (MEK:IPA:DMF=5:4:1): 100 parts A colored pigment (brown): 0.6 part The primer resin (1) was coated with a 70 mesh roll in one rolling operation at a rate of 35 g/$m^2$, and the primer resin (2) was then coated with a 70 mesh roll in three rolling operations and with a 110 mesh roll in one rolling operation at a total rate of 130 g/$m^2$.

Subsequently, the surface of the primer-coated sheet was treated with an emboss machine equipped with a steam-sealed emboss roll at a roll surface temperature of 180° C., a pushing pressure of 350 kg/m and a treating speed of 1.5 m/min to obtain the sheet having independent hills. As the emboss roll, made and then used was a roll which could be heated with a heating medium and had a complement type mold having independent conical trapezoidal sunk portions at a rate of 24 sunk portions/$cm^2$ and giving transferred hills having a top portion maximum diameter of 1.8 mm, a slope portion maximum diameter of 2.3 mm and a conical trapezoidal shape height of 0.6 mm.

The embossed sheet had the conical trapezoidal hills, and had 1 to 200 μm-diameter opened pores at an average rate of 500 opened pores per hill on the sides of the hills. The opened pores were much distributed in the hill side shoulder portions of the sides. A through pore did not exit in the top portions of the hills.

Subsequently, a coating having a color contrasted with the color of the emboss valley portions was coated on the emboss top portions to impart a grade and a design as a ball to the top portions.

Herein, a resin used as an elastic polymer (C) in a top coating (1) was the polycarbonate-based alicyclic non-yellowing polyurethane (100% extension stress 130 kg/$cm^2$, solid content 20%) used in the primer coating (1). As the top coating (1), a coating prepared by adding a dark brown pigment as a colored pigment to the primer coating (1) and having a resin concentration of 11% was used, and once coated with a 110 mesh gravure roll to give a wet basis weight of 25 g/m$^2$. Then, a 13% solution of the silicone-modified polycarbonate-based non-yellowing polyurethane used in the primer coating (2) was coated at a rate of 40 g/m$^2$ as a top coating (2).

Then, a top coating (3) containing a gripping property-improving agent to finish into a surface satisfying the main characteristics, such as touch, gripping property, soiling resistance and abrasion resistance, of balls was prepared, coated three times with a 70 mesh gravure roll in a film-like state at a rate of 60 g/m$^2$, and then dried.

Primer Resin (3)

A silicone-modified polycarbonate-based non-yellowing polyurethane resin (100% extension stress 65 kg/cm$^2$, solid content 20%): 100 parts A low molecular weight polybutadiene (molecular weight 2000): 15 parts Silica: 0.3 part A solvent mixture (MEK:IPA:DMF=5:4:1): 343 parts The obtained leather-like sheet had a water-absorbing time of 300 seconds and was suitable, and the gripping property on wetting was sufficiently excellent. The leather-like sheet was processed into balls for American football, and then evaluated. Consequently, the balls little slipped in a sweat-adhered state, had a good gripping property, did not cause the excessive absorption of water, scarcely increased the weights of the balls during games, and did further not have a problem on abrasion resistance.

The substrate characteristics of the obtained leather-like sheet were shown in Table 1 and Table 2.

TABLE 1

| Items | Example 1 | Example 2 | Example 3 | Example 4 | Example 5 |
|---|---|---|---|---|---|
| Substrate layer | | | | | |
| Nap length mm | 0.06 | 0.06 | 0.03 | 0.06 | 0.06 |
| Ultra fine fiber fineness dtex | 0.003 | 0.003 | 0.0005 | 0.003 | 0.003 |
| Resin/fiber ratio (R/F) | 1.22 | 0.66 | 1.20 | 1.21 | 1.4 |
| #1 | | | | | |
| #2 | 3.5 | 3.5 | 3.5 | 3.5 | 3.3 |
| #3 | 13.0 | 13.0 | 13.0 | 18.0 | 13.2 |
| #4 | | | | | |
| #5 | 3.0 | 3.0 | 3.0 | 3.0 | 3.0 |
| #6 | 4.0 | 4.0 | 4.0 | 4.0 | 4.0 |
| #7 | 6.0 | 6.0 | 6.0 | 6.0 | 6.0 |
| #8 | | | | | |
| #9 | 500 | 500 | 500 | 500 | 500 |
| #10 | 1 to 200 | 1 to 200 | 1 to 200 | 1 to 200 | 1 to 200 |
| #11 | 100 | 100 | 100 | 100 | 100 |
| #12 | 1 to 200 | 1 to 200 | 1 to 200 | 1 to 200 | 1 to 200 |

#1: Composite layer (elastic polymer B) g/m$^2$
#2: Primer (1) coating amount (solid content)
#3: Primer (2) coating amount (solid content)
#4: Coating layer (elastic polymer C) g/m$^2$
#5: Top coating (1) coating amount (solid content)
#6: Top coating (2) coating amount (solid content)
#7: Top coating (3) coating amount (solid content)
#8: Number of through pores/diameters of through pores in hill
#9: Side portion number through pores
#10: diameters of through pores μm
#11: Valley bottom portion number through pores
#12: diameters of through pores μm

TABLE 2

| Items | Example 1 | Example 2 | Example 3 | Example 4 | Example 5 |
|---|---|---|---|---|---|
| Surface material | | | | | |
| Dry friction coefficient | 1.0 | 1.0 | 1.0 | 1.0 | 1.0 |
| Wet friction coefficient | 1.1 | 1.1 | 1.15 | 1.1 | 1.1 |
| Abrasion resistance rank | 4 | 4 | 4 | 5 | 4 |
| Soiling resistance rank | 4 | 4 | 4 | 5 | 4 |
| Emboss sharpness rank | 4 to 5 | 4 | 4 to 5 | 5 | 4 to 5 |
| Emboss durability rank | 4 to 5 | 4 | 4 to 5 | 5 | 4 to 5 |
| Touch rank | 5 | 5 | 5 | 5 | 5 |
| Dry gripping property rank | 4 | 4 | 4 | 4 | 4 |
| Wet gripping property rank | 4 | 4 | 4 | 4 | 4 |
| Water-absorbing time second | 300 | 300 | 300 | 300 | 300 |

Example 2

A leather-like sheet was produced similarly to Example 1, except that an impregnation solution prepared by diluting the impregnation solution for the substrate in Example 1 with DMF was used. The R/F (resin/fiber ratio) of the obtained substrate layer was 0.66, while that in Example 1 was 1.22. The obtained sheet had some difference between the emboss sharpness thereof and that in Example 1, but the difference was practically negligible. The abrasion resistance, touch and gripping property of the obtained sheet were excellent. The substrate characteristics of the obtained leather-like sheet were shown in both Table 1 and Table 2.

Example 3

In stead of the blend-spun fibers used in Example 1, nylon-6/low density polyethylene were blended in a ratio of 50/50, melted in an extruder, and then spun, while shortening the retention time of the melted polymers in a pack to ⅓ of that in Example 1. The nylon-6 of the island component of the obtained blend-spun fibers had an average fineness of 0.0005 dtex. The fibers were used and processed similarly to Example 1. The obtained leather-like sheet had a good surface grade, rich abrasion resistance, and a rich gripping property as a ball material. The substrate characteristics of the obtained leather-like sheet were shown in both Table 1 and Table 2.

Example 4

The production of a leather-like sheet was performed under conditions according to those in Example 1 except that 70 mesh, 2 roll operations were added to the primer resin (2) in Example 1 and the coating amount of the primer resin (2) was increased from 13 g/m$^2$ to 18 g/m$^2$. The obtained sheet had rich surface smoothness, good abrasion resistance, and a non-excessively large water-absorbing rate, and satisfied demand characteristics. The substrate characteristics of the obtained leather-like sheet were shown in both Table 1 and Table 2.

Example 5

As an impregnation solution, polyhexamethylenecarbonatediol having a molecular weight of 2,000, diphenylmethane-4,4'-diisocyanate, and ethylene glycol were allowed to react in dimethylformamide as a solvent to obtain a polyurethane elastomer (solid content concentration 30%, 100% extension stress 80 kg/cm$^2$, thermosoftening temperature 185° C.).

The obtained polyurethane elastomer was diluted with DMF to make an impregnation solution containing the polyurethane in a concentration of 22%. The blend-spun fiber nonwoven fabric used in Example 1 was immersed in the impregnation solution, and then repeatedly nipped and relaxed with metal rolls five times. Similarly to Example 1, the treated nonwoven fabric was immersed in 95° C. hot toluene, repeatedly compressed and relaxed with stainless steel nip rolls having stamped surfaces to extract and remove the polyethylene, and then immersed in 100° C. hot water to azeotropically remove the toluene. The sheet was impregnated with the impregnation resin in an amount of 1.4 times the weight of the fibers.

The sheet was subjected to processing treatments similarly to Example 1 to process into a leather-like sheet. The obtained leather-like sheet for a ball raw fabric had greatly high emboss pattern sharpness, and had very high pattern durability, when processed into balls and then repeatedly subjected to practical tests, excellent tough, and an excellent gripping property. But, the leather-like sheet caused little a change of the weight by the absorption of water during playing. Therefore, the leather-like sheet was especially excellent as a surface material for balls used in American football and basketball. The substrate characteristics of the obtained leather-like sheet were shown in both Table 1 and Table 2.

Comparative Example 1

In stead of the blend-spun fibers used in Example 1, conjugated fibers (fineness 4.5 dtex, length 51 mm) having nineteen 0.2 dtex nylon-6 fibers in one parent fiber and containing polyethylene as a sea component were prepared. A sheet was prepared, while other conditions were in accordance with Example 1. The results were shown in Table 1. The surface nap fibers of the obtained sheet could not be bound with the primer coating, and were fuzzy, also when processed. Therefore, the grade of the sheet was low, also after processed into balls. The substrate characteristics of the obtained leather-like sheet were shown in Table 3 and Table 4.

TABLE 3

| Items | Comparative Example 1 | Comparative Example 2 | Comparative Example 3 | Comparative Example 4 |
|---|---|---|---|---|
| Substrate layer | | | | |
| Nap length mm | 0.1 | 0.08 | 0.06 | Nothing |
| Ultra fine fiber fineness dtex | 0.2 | 0.003 | 0.006 | 0.003 |
| Resin/fiber ratio (R/F) | 1.22 | 0.26 | 0.24 | 0.26 |

TABLE 3-continued

| Items | Comparative Example 1 | Comparative Example 2 | Comparative Example 3 | Comparative Example 4 |
|---|---|---|---|---|
| #1 | | | | |
| #2 | 4.0 | 3.5 | — | — |
| #3 | 13.0 | 13.0 | — | — |
| #4 | | | | |
| #5 | 3.0 | 3.0 | — | 7.0 |
| #6 | 4.0 | 4.0 | — | — |
| #7 | 6.0 | 6.0 | 6.0 | 6.0 |
| #8 | | | | |
| #9 | 500 | 500 | 500 | 1500 |
| #10 | 1 to 200 | 1 to 200 | 1 to 200 | 1 to 200 |
| #11 | 50 | 50 | 50 | 50 |
| #12 | 30 | 30 | 30 | 2.2 |

#1: Composite layer (elastic polymer B) g/m$^2$
#2: Primer (1) coating amount (solid content)
#3: Primer (2) coating amount (solid content)
#4: Coating layer (elastic polymer C) g/m$^2$
#5: Top coating (1) coating amount (solid content)
#6: Top coating (2) coating amount (solid content)
#7: Top coating (3) coating amount (solid content)
#8: Number of through pores/diameters of through pores in hills
#9: Side portions number through pores
#10: diameters of through pores μm
#11: Valley bottom portions number through pores
#12: diameters of through pores μm

TABLE 4

| Items | Comparative Example 1 | Comparative Example 2 | Comparative Example 3 | Comparative Example 4 |
|---|---|---|---|---|
| Surface material | | | | |
| Dry friction coefficient | 1.0 | 1.1 | 1.1 | 2.3 |
| Wet friction coefficient | 1.1 | 1.15 | 1.25 | 2.0 |
| Abrasion resistance rank | 4 | 4 | 2 | 4 |
| Soiling resistance rank | 4 | 4 | 2 | 4 |
| Emboss sharpness rank | 3 to 4 | 3 | 4 | 3 |
| Emboss durability rank | 3 to 4 | 3 | 4 | 3 |
| Touch rank | 4 | 3 to 4 | 2 | 3 |
| Dry gripping property rank | 4 | 4 | 3 | 3 |
| Wet gripping property rank | 4 | 4 | 3 | 3 |
| Water-absorbing time second | 300 | 300 | 60 | 300 |

Comparative Example 2

An impregnated substrate, and a leather-like sheet were produced under conditions according to those of Example 1 except that the concentration of the impregnation solution used in Example 1 was changed into 14% (polyurethane elastomer 20% solution; 100 parts, DMF; 42.9 parts). The obtained substrate had a low resin:fiber ratio of 0.26, and gave a final sheet which had an emboss pattern defective in sharpness and largely changed during employment and was inferior in grade as a ball material. The substrate characteristics of the obtained leather-like sheet were shown in both Table 3 and Table 4.

Comparative Example 3

The nap sheet buffed and obtained in Example 1 was embossed for balls used in basketball without being coated with a primer coating, and then once coated with a finishing coating containing a gripping property-improving agent with a 40 mesh gravure stamped roll without being coated with a top coating resin. Since a resin coating film was not formed on the nap side of the product, the product was easily soiled and was also insufficient in abrasion resistance. The substrate characteristics of the obtained leather-like sheet were shown in both Table 3 and Table 4.

Comparative Example 4

The nonwoven fabric comprising the blend-spun fibers obtained in Example 1 was impregnated with an impregnation resin. Subsequently, a 15% solution of a polyurethane elastomer having the same composition as that of the impregnation resin was recoated on the surface of the substrate, and then wet-coagulated to obtain the sheet having a polyurethane wet porous layer on the surface.

The sheet was pressed with an emboss roll having a basketball pattern at a surface temperature of 160° C. to obtain the sheet having independent hills.

The embossed sheet had the conical trapezoidal hills, and 1 to 20 μm opened pores existed on the sides of the hills at an average rate of 2,000 opened pores per hill.

Subsequently, 100 parts of a polyurethane elastomer having the same polyurethane resin composition as that of the porous layer, 200 parts of a solvent mixture of MEK:IPA:DMF=5:4:1, and 1 part of a brown pigment were mixed with each other to prepare a coating solution having a concentration of 10.3% and a viscosity of 140 cps. The coating solution was coated on the top portions of the embossed raw fabric prepared previously.

Furthermore, 100 parts of the coating resin was mixed and dissolved with 343 parts of the same solvent mixture, 0.6 part of a brown pigment, 15 parts of polybutadiene having a molecular weight of 2,000, and 0.3 part of silica. The obtained coating containing the tackifier and used for coating layers was coated.

The obtained leather-like sheet had good abrasion resistance, a good gripping property, and the like, but did still not have a sufficient touch, when processed into a ball. The substrate characteristics of the obtained leather-like sheet were shown in both Table 3 and Table 4.

INDUSTRIAL APPLICABILITY

According to the present invention, provided are a leather-like sheet which has an excellent gripping property and excellent abrasion resistance, when dried and also when wetted, little causes the change in the weight of the sheet due to the excessive absorption of sweat and the absorption of rain water, and is especially suitable for balls used in games such as basketball, rugby, American football, and handball, a method for producing the leather-like sheet, and a ball using those.

What is claimed is:

1. A method for producing an artificial leather sheet, comprising:

(i) coating a solution comprising an elastic polymer (B) on a substrate layer for forming a composite layer on a surface of the substrate layer, wherein the substrate layer comprises ultra fine fibers and an elastic polymer (A), the fineness of the ultra fine fibers is 0.0001 to 0.05 dtex, the composite layer comprises ultra fine fiber naps and an elastic polymer (B), the ultra fine naps are connected to the fibers constituting the substrate layer, and the elastic polymer (B) is joined to the ultra fine fibers;

(ii) pressing the surface of the sheet with an emboss roll for forming hills; and (iii) then coating the top portions of the hills with a solution comprising an elastic polymer (C), wherein the solution of the elastic polymer (C) comprises two solutions of elastic polymers, (C1) and (C2), and the top portions of the hills are coated with the solution of an elastic polymer (C1), dried, and then coated with the solution of an elastic polymer (C2) containing a tackifier.

2. The method for producing an artificial leather sheet according to claim 1, wherein the differences of elevation between the top portions and the valley bottom portions of the hills are not less than 0.1 mm.

3. The method for producing an artificial leather sheet according to claim 1, wherein the average area of the top portions of the hills is 0.5 to 7 $mm^2$.

4. The method for producing an artificial leather sheet according to claim 1, wherein the ratio (R/F) of the weight (R) of the elastic polymer (A) in the sheet to the weight (F) of the ultra fine fibers is in the range of 0.5 to 1.5.

5. The method for producing an artificial leather sheet according to claim 1, wherein the sheet is a sheet produced by impregnating the elastic polymer (A) into a structure comprising ultra fine fiber-forming fibers and then converting the ultra fine fiber-forming fibers into ultra fine fibers.

6. The method for producing an artificial leather sheet according to claim 1, wherein the sheet is a sheet produced by impregnating the elastic polymer (A) and then wet-coagulating the product.

7. The method for producing an artificial leather sheet according to claim 1, wherein the solution of the elastic polymer (B) comprises two solutions of elastic polymers, (B1) and (B2), and the sheet is coated with the solution of an elastic polymer (B1), dried, and then coated with the solution of an elastic polymer (B2).

8. The method for producing an artificial leather sheet according to claim 7, wherein the elastic polymer (B2) is a silicone-modified polyurethane.

9. The method for producing an artificial leather sheet according to claim 1, wherein the tackifier is a liquid rubber or a rosin resin.

10. The method for producing an artificial leather sheet according to claim 9, wherein the liquid rubber is a synthetic liquid rubber having a molecular weight of 800 to 5,000.

11. The method for producing an artificial leather sheet according to claim 1, wherein the surface of the substrate layer is abraded to obtain the ultra fine fiber naps.

12. The method for producing an artificial leather sheet according to claim 1, wherein the substrate layer is obtained by impregnating a nonwoven fabric comprising sea-island type mixed spun fibers with a polyurethane resin, dissolving and removing the sea component of the obtained fibrous substrate to obtain the sheet having the ultra fine fibers, subjecting the sheet to a gravure treatment using a solvent which can dissolve the elastic polymer but not dissolve the fibers to fix the surface of the sheet, and then abrading the surface to obtain the ultra fine fiber naps.

* * * * *